US009125532B2

(12) United States Patent
Bechyne

(10) Patent No.: US 9,125,532 B2
(45) Date of Patent: Sep. 8, 2015

(54) STORING AND DISPENSING CONTAINER FOR WIPES

(71) Applicant: Kimberly-Clark Worldwide, Inc., Neenah, WI (US)

(72) Inventor: Christopher M. Bechyne, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 17 days.

(21) Appl. No.: 13/721,572

(22) Filed: Dec. 20, 2012

(65) Prior Publication Data

US 2014/0175110 A1 Jun. 26, 2014

(51) Int. Cl.
*A47K 10/42* (2006.01)
*A47K 10/32* (2006.01)

(52) U.S. Cl.
CPC ..... *A47K 10/421* (2013.01); *A47K 2010/3266* (2013.01)

(58) Field of Classification Search
CPC ..... B65D 25/005; B65D 43/0202; B65D 43/0214; B65D 83/0805; B65H 1/00
USPC ..... 206/494, 233, 581, 210, 810; 220/796, 220/916, 229; 221/63
See application file for complete search history.

(56) References Cited

U.S. PATENT DOCUMENTS 685,900 A 11/1901 Anderson
715,033 A 12/1902 Doolittle
995,720 A 6/1911 Reiss
1,293,291 A * 2/1919 Albig ..... 221/34
2,585,602 A 2/1952 Turner
3,141,569 A 7/1964 Hanson
3,221,873 A 12/1965 Bowes et al.
3,319,782 A 5/1967 Bowes
4,863,064 A * 9/1989 Dailey, III ..... 221/48
4,865,221 A 9/1989 Jackson et al.
4,921,103 A * 5/1990 Cohen ..... 206/523

(Continued)

FOREIGN PATENT DOCUMENTS

CN 2920832 Y 7/2007
EP 1035026 A1 9/2000

(Continued)

OTHER PUBLICATIONS

Co-pending U.S. Appl. No. 13/330,871, filed Dec. 20, 2012, by Hill et al. for "Wipes Dispenser with Angled Dispensing."

*Primary Examiner* — Anthony Stashick
*Assistant Examiner* — Jennifer N Zettl
(74) *Attorney, Agent, or Firm* — Kimberly-Clark Worldwide, Inc.

(57) ABSTRACT

A container for wipes includes a dispenser housing. The housing defines top and bottom walls, first and second side walls, and first and second end walls. The walls collectively define an interior space. The top wall includes a dispensing orifice which is covered by a lid assembly. The lid assembly includes a ring and a flip top. The ring is permanently affixed to the top wall, and the flip top is hingedly connected to the ring. The ring has an upper portion and a buffering flange. The upper portion generally extends along the dispensing orifice perimeter. In one embodiment, the buffering flange protrudes from the upper portion into the interior space, and a height of the buffering flange is greater than a thickness of the top wall. In another embodiment, the buffering flange protrudes from the upper portion into the interior space past the inner surface of the top wall.

14 Claims, 18 Drawing Sheets

(56) References Cited

U.S. PATENT DOCUMENTS

| | | | | |
|---|---|---|---|---|
| 5,040,680 | A | 8/1991 | Wilson et al. | |
| 5,083,671 | A * | 1/1992 | Hayes | 215/245 |
| 5,163,558 | A | 11/1992 | Palumbo et al. | |
| 5,197,658 | A | 3/1993 | Sprunger | |
| 5,409,181 | A * | 4/1995 | Patrick | 242/596.2 |
| 5,746,369 | A * | 5/1998 | McDermott | 229/120.03 |
| 5,797,542 | A * | 8/1998 | O'Connor | 229/109 |
| 6,186,082 | B1 * | 2/2001 | Drobek | 111/92 |
| 6,296,143 | B1 * | 10/2001 | Ghabriel | 221/34 |
| 6,349,525 | B1 * | 2/2002 | Veith | 53/429 |
| 6,349,849 | B1 * | 2/2002 | Pehr | 221/33 |
| 6,481,589 | B2 | 11/2002 | Blomdahl et al. | |
| 6,523,690 | B1 * | 2/2003 | Buck et al. | 206/494 |
| 6,604,628 | B1 * | 8/2003 | Tanaka et al. | 206/209 |
| 6,672,474 | B2 * | 1/2004 | May et al. | 221/34 |
| 6,702,109 | B1 * | 3/2004 | Tabuchi | 206/233 |
| 6,766,919 | B2 | 7/2004 | Huang et al. | |
| 6,971,542 | B2 | 12/2005 | Vogel et al. | |
| D513,585 | S | 1/2006 | Biesecker et al. | |
| 7,028,840 | B2 | 4/2006 | Huang et al. | |
| 7,055,686 | B2 * | 6/2006 | De-Vries | 206/233 |
| D533,781 | S | 12/2006 | Freisem et al. | |
| 7,172,093 | B2 * | 2/2007 | Bando | 221/63 |
| 7,275,658 | B2 | 10/2007 | Decker et al. | |
| 7,510,095 | B2 | 3/2009 | Comeau et al. | |
| 7,621,401 | B2 | 11/2009 | Alegre | |
| 7,621,420 | B2 | 11/2009 | Bandoh et al. | |
| 7,794,382 | B2 * | 9/2010 | Cheich | 493/464 |
| 7,992,744 | B2 | 8/2011 | Szymanski et al. | |
| 8,016,155 | B2 | 9/2011 | Decker et al. | |
| 8,397,944 | B1 | 3/2013 | Landes | |
| 2002/0179625 | A1 | 12/2002 | Huang et al. | |
| 2003/0005617 | A1 | 1/2003 | Holverson, Jr. | |
| 2003/0006253 | A1 | 1/2003 | Yelton et al. | |
| 2004/0118862 | A1 | 6/2004 | Amundson | |
| 2004/0251292 | A1 * | 12/2004 | Grebonval et al. | 225/39 |
| 2005/0133387 | A1 * | 6/2005 | Cohen et al. | 206/233 |
| 2005/0205594 | A1 * | 9/2005 | Evans et al. | 221/63 |
| 2005/0211716 | A1 | 9/2005 | Decker et al. | |
| 2005/0242165 | A1 * | 11/2005 | Cargile | 229/242 |
| 2006/0131370 | A1 * | 6/2006 | Bates | 229/122 |
| 2006/0151518 | A1 * | 7/2006 | Sarbo et al. | 221/63 |
| 2006/0175222 | A1 * | 8/2006 | Holland et al. | 206/494 |
| 2006/0249524 | A1 | 11/2006 | Headrick | |
| 2007/0131703 | A1 * | 6/2007 | Szymonski et al. | 221/50 |
| 2007/0246390 | A1 | 10/2007 | Alexander | |
| 2007/0284386 | A1 * | 12/2007 | Shoemaker | 221/63 |
| 2008/0073312 | A1 | 3/2008 | Babcock et al. | |
| 2008/0142536 | A1 * | 6/2008 | Cohen et al. | 221/48 |
| 2008/0272016 | A1 * | 11/2008 | Anderson et al. | 206/233 |
| 2009/0050504 | A1 * | 2/2009 | Stechschulte et al. | 206/459.5 |
| 2009/0194553 | A1 | 8/2009 | Hoefing et al. | |
| 2009/0308777 | A1 * | 12/2009 | Banik et al. | 206/494 |
| 2009/0321299 | A1 * | 12/2009 | Gehring | 206/581 |
| 2010/0122985 | A1 * | 5/2010 | Peters et al. | 220/262 |
| 2011/0011767 | A1 * | 1/2011 | Gehring et al. | 206/581 |
| 2011/0152812 | A1 | 6/2011 | Hird et al. | |
| 2011/0155609 | A1 | 6/2011 | Mueller et al. | |
| 2011/0240514 | A1 * | 10/2011 | Bandoh et al. | 206/555 |
| 2011/0309099 | A1 * | 12/2011 | Bandoh et al. | 220/849 |
| 2012/0084908 | A1 * | 4/2012 | Dunn et al. | 4/483 |
| 2012/0160864 | A1 | 6/2012 | Shoaf et al. | |
| 2012/0175280 | A1 | 7/2012 | Bando et al. | |
| 2012/0251748 | A1 | 10/2012 | Ashmead et al. | |
| 2012/0283084 | A1 | 11/2012 | Cheich et al. | |
| 2012/0325716 | A1 | 12/2012 | Evenson et al. | |

FOREIGN PATENT DOCUMENTS

| | | | | |
|---|---|---|---|---|
| EP | 1717162 | A1 * | 11/2006 | A47K 10/42 |
| FR | 2442776 | A1 | 6/1980 | |
| GB | 1281920 | A | 7/1972 | |
| GB | 2284801 | A | 6/1995 | |
| JP | 09-002547 | A | 1/1997 | |
| JP | 09-002548 | A | 1/1997 | |
| JP | 2002-051932 | A | 2/2002 | |
| JP | 2002-053126 | A | 2/2002 | |
| JP | 2008-100749 | A | 5/2008 | |
| JP | 2008-272291 | A | 11/2008 | |
| JP | 2008-307779 | A | 12/2008 | |
| JP | 2012-201391 | A | 10/2012 | |
| KR | 20-1996-0003619 | Y1 | 4/1996 | |
| KR | 10-2002-0093207 | A | 12/2002 | |
| KR | 20-0337066 | Y1 | 12/2003 | |
| KR | 10-2010-0025888 | A | 3/2010 | |
| KR | 10-2011-0008812 | A | 1/2011 | |
| TW | M 367906 | U | 11/2009 | |
| WO | WO 93/17933 | A1 | 9/1993 | |
| WO | WO 03/017237 | A1 | 2/2003 | |

* cited by examiner

STORING AND DISPENSING CONTAINER FOR WIPES

BACKGROUND OF THE INVENTION

There are a variety of storing and dispensing containers in the market, particularly those for storing and dispensing wipe type products. Wipe-type products or wipes have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes each folded wet wipe is interfolded with the wet wipes immediately above and below it in the stack of wipes. In an alternative configuration, the wet wipes have been placed in a container in the form of a continuous web of material that includes perforations adapted to allow for separation of individual wet wipes from the web upon the application of a pulling force. Such wet wipes have been used for baby wipes, hand wipes, personal care wipes, household cleaning wipes, industrial wipes and the like.

Conventional packages of wipes have typically been designed to be positioned on a flat surface such as a countertop, table or the like. Such conventional packages have often included a plastic container, tub or package which provides a sealed environment for the wet wipes to ensure that they do not become dirty or overly dry. Some of the conventional packages have also been configured to provide "one-at-a-time" dispensing of each wet wipe which can be accomplished using a single hand after the package has been opened. Such single-handed, one-at-a-time dispensing is particularly desirable because the other hand of the user or care giver is typically required to be simultaneously used for other functions. For example, when changing a diaper product on an infant, the care giver typically uses one hand to hold and maintain the infant in a desired position while the other hand is used to dispense a baby wipe to clean the infant.

"Pop-up" configurations of wet wipe dispensers can advantageously help provide the aforementioned single-handed, "one-at-a-time" dispensing. In "pop-up" configurations, when a wipe is removed from the dispenser, the wipe pulls along the leading end of the succeeding wipe in the package, by virtue of the succeeding wipe being in operative contact with the leading wipe such as via interfolding, via adhesive bonding, or via an integral connection along a line of weakness. Preferably, as the leading wipe is pulled out of and away from the package, the trailing end of the leading wipe breaks free from the leading end of the succeeding wipe, and the leading end of the succeeding wipe is left protruding from the package. In this way, the leading end of the succeeding wipe is immediately and automatically positioned for grasping and subsequent withdrawal from the package, and what was previously the succeeding wipe now becomes the leading wipe.

Although moist wipes are most commonly used in conjunction with diapering, moist wipes are increasingly being used for non-diapering purposes, such as cleaning of the face and hands, cleaning up messes, and other uses. Frequently, users wish to have wipes available in locations other than in the nursery, such as in other rooms of the home, or when traveling. Many conventional "pop-up" wipe dispensers are large, not easily portable, and engender images of baby diapering. On the other hand, many conventional "on the go" wipes dispensers are made of flexible plastic film material, and are not optimal in terms of quality, and are not designed to be refilled. What is needed in the art is a wipes dispenser that in particular embodiments does not have the appearance of common baby wipes "tubs," that in particular embodiments is relatively portable, and in particular embodiments can be refilled, at least to reduce packaging waste.

SUMMARY OF THE INVENTION

The present invention pertains to a container for moist wipes. The container includes a dispenser housing. The housing defines a top wall spaced apart from and generally parallel to a bottom wall, a first side wall spaced apart from and generally parallel to a second side wall, and a first end wall spaced apart from and generally parallel to a second end wall. The walls collectively define an interior space. The top wall includes a dispensing orifice through which wipes can be extracted from the interior space, and the top wall is spaced apart from the bottom wall in a height dimension. The interior space has an interior space height that extends from an inner surface of the top wall to an inner surface of the bottom wall, and the dispensing orifice defines a dispensing orifice perimeter. The dispensing orifice is covered by a lid assembly. The lid assembly includes a ring and a flip top. The ring is permanently affixed to the top wall, and the flip top is hingedly connected to the ring. The ring has an upper portion and a buffering flange. The upper portion overlaps and generally extends along the dispensing orifice perimeter.

In one embodiment, the buffering flange protrudes from the upper portion into the interior space, and a height of the buffering flange is greater than a thickness of the top wall.

In another embodiment, the buffering flange protrudes from the upper portion into the interior space past the inner surface of the top wall.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts of the packages depicted in the drawings are referred to by the same reference numerals.

DETAILED DESCRIPTION OF PARTICULAR EMBODIMENTS

Figure 1A:
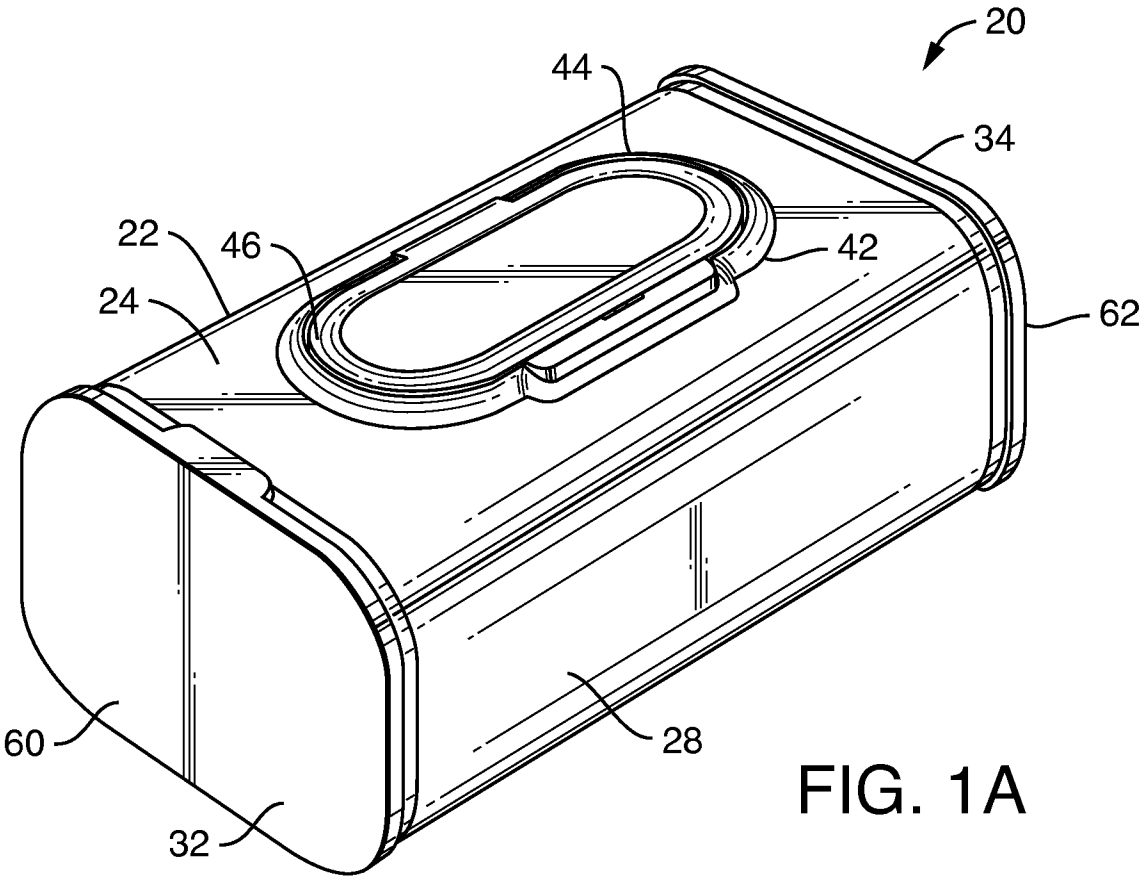
FIG. 1A representatively illustrates a left front perspective view of one embodiment of the present invention, with the flip top in the closed position and with both end wall removable caps attached.
Figure 1B:
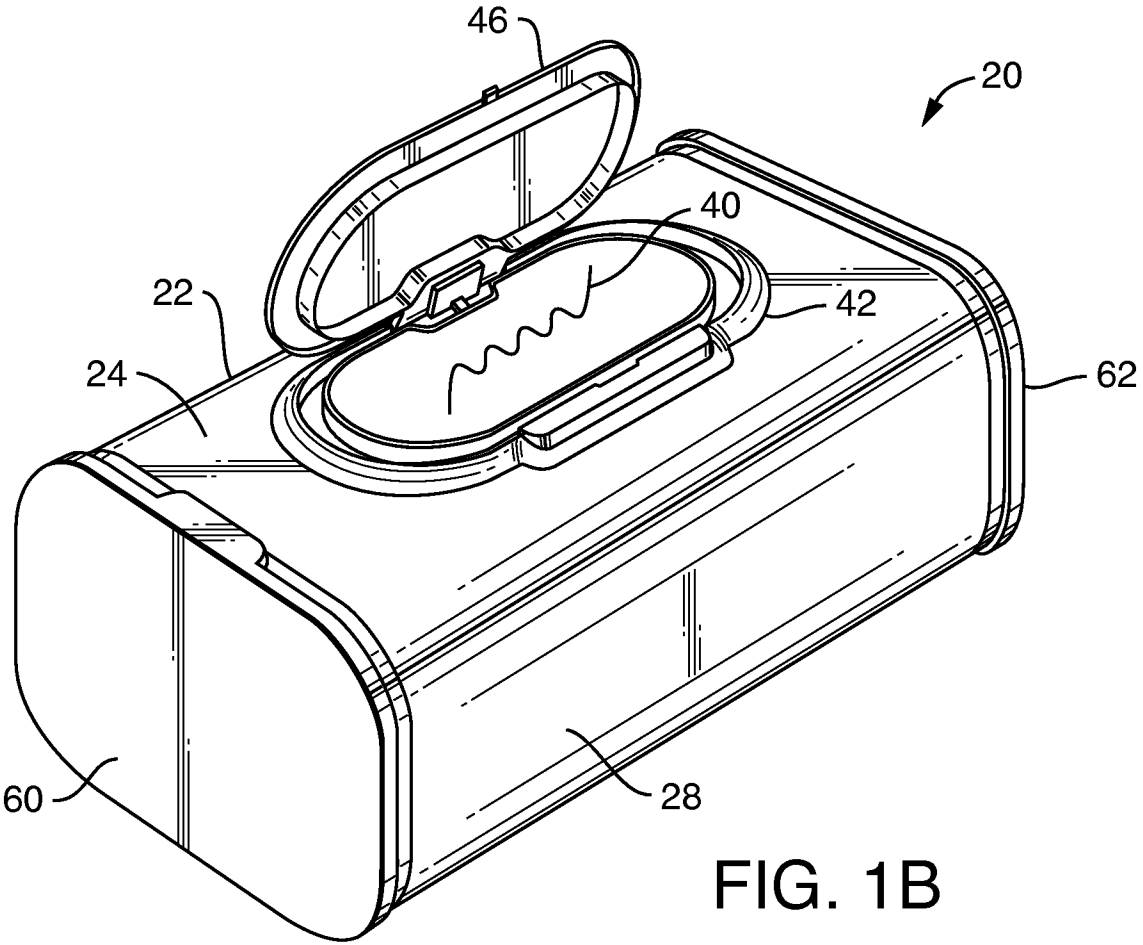
FIG. 1B representatively illustrates the embodiment of FIG. 1A, but with the flip top in the open position.
Figure 1C:
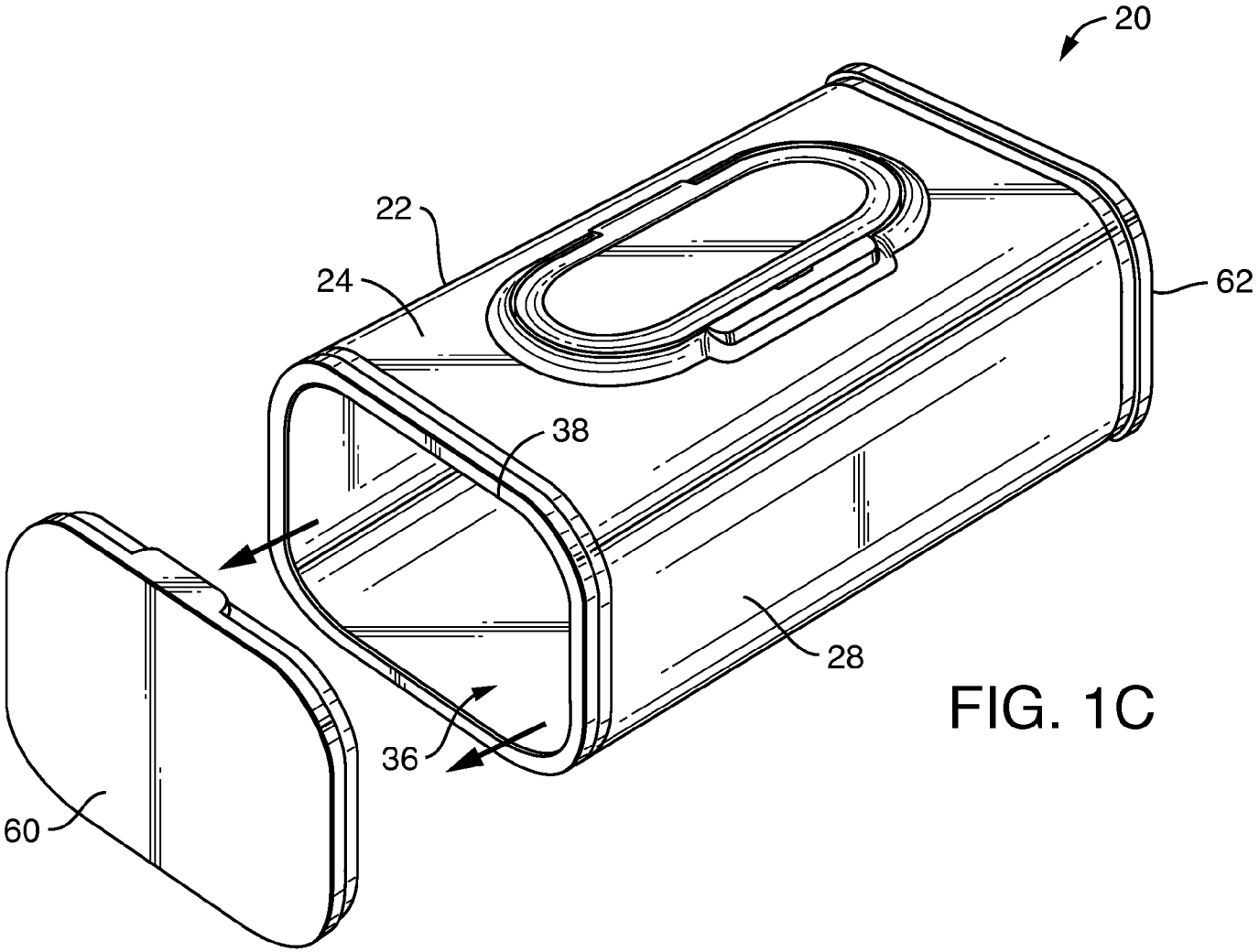
FIG. 1C representatively illustrates the embodiment of FIG. 1A, but with one end wall removable cap unattached.
Figure 2:
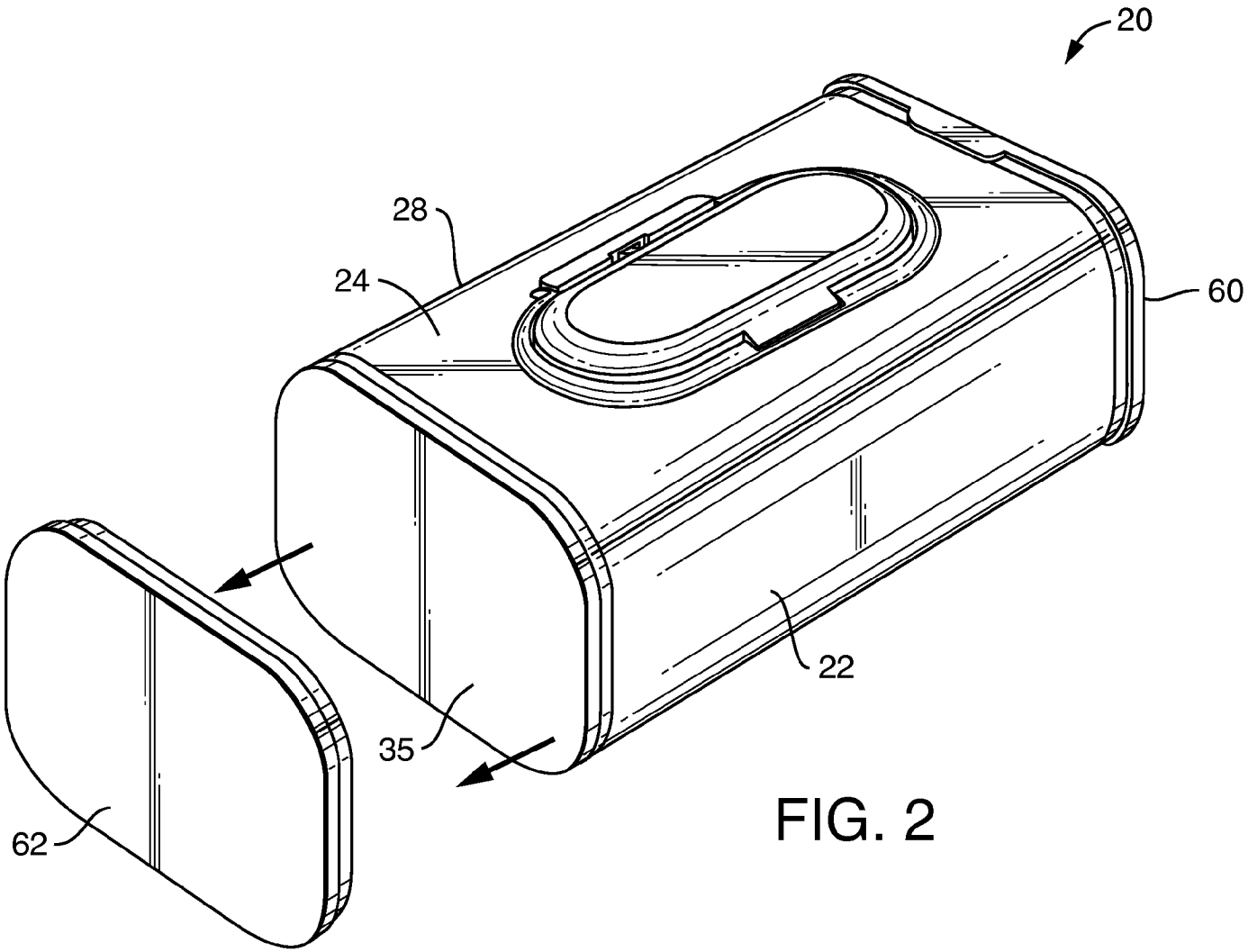
FIG. 2 representatively illustrates a rear right perspective view of the embodiment of FIG. 1A, but with one end wall removable cap unattached.
Figure 4:
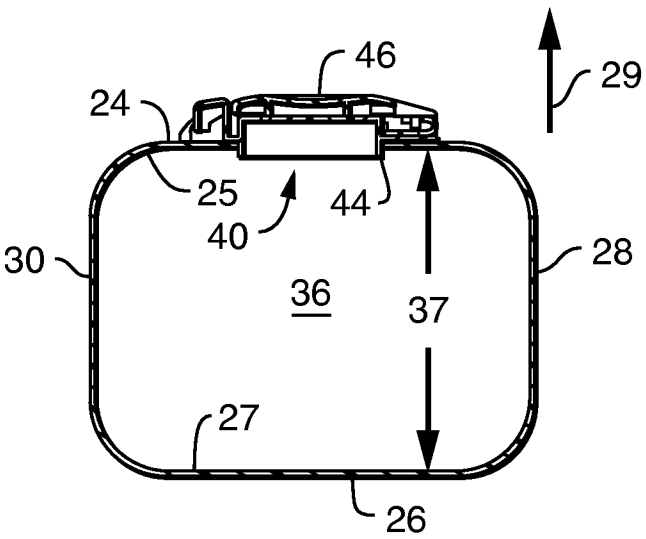
FIG. 4 representatively depicts a cross-sectional view of the embodiment of FIG. 3 taken at line 4-4.
Figure 3:
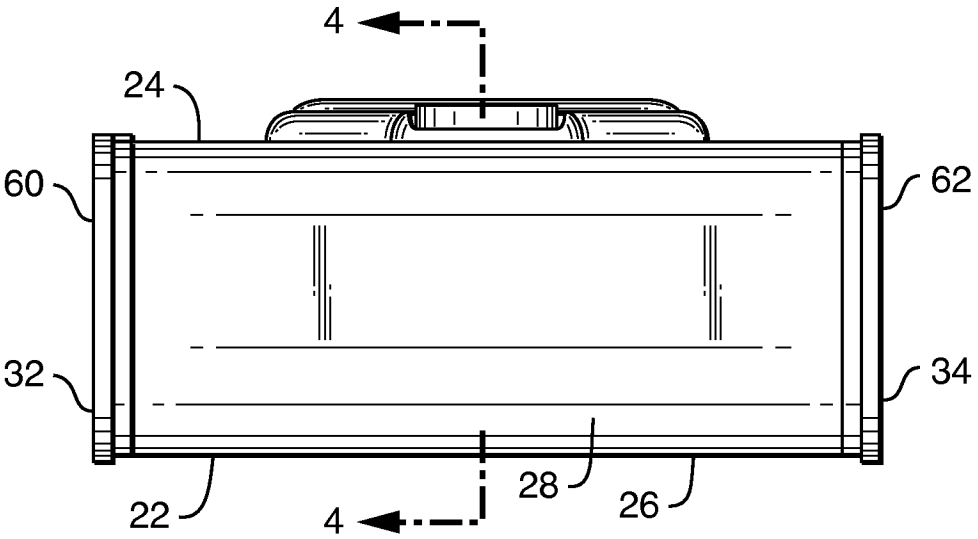
FIG. 3 representatively illustrates a front view of the embodiment of FIG. 1A.
Figure 6:
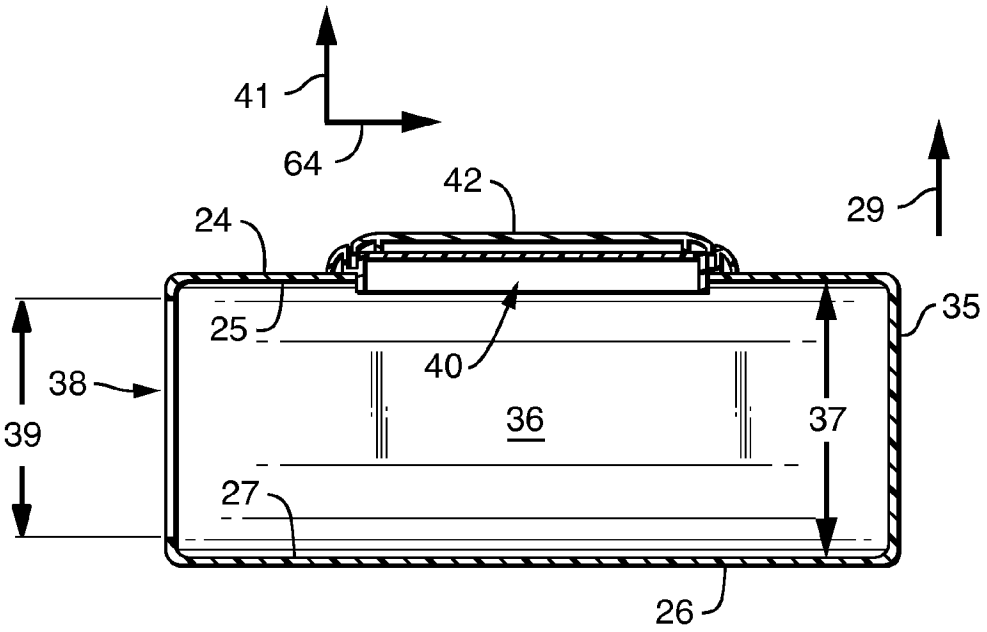
FIG. 6 representatively depicts a cross-sectional view of the embodiment of FIG. 5 taken at line 6-6.

Referring to FIGS. 1-12, the present invention in particular embodiments pertains to a container of moist wipes. The container 20 includes a dispenser housing 22 and a stack 50 of moist wipes 52. The dispenser housing 22 includes a top wall 24 spaced apart from and generally parallel to a bottom wall 26. The dispenser housing 22 further includes a first side wall 28 spaced apart from and generally parallel to a second side wall 30. The dispenser housing 22 further includes a first end wall 32 spaced apart from and generally parallel to a second end wall 34. "Generally parallel" as used herein means disposed between zero and about 30 degrees relative to each other. The walls, 24/26/28/30/32/34 connect together to define an interior space 36. In particular embodiments, the top wall 24, the bottom wall 26, the first side wall 28, the second side wall 30, and at least one layer of the second end wall 34 are integrally molded with each other. When walls 24/26/28/30/32/34 are all connected, the interior space is preferably moisture impervious, so that the moist wipes 52 within the interior space do not dry out. Preferably, the housing 22 is a polyhedron, such as a parallelepiped.

The housing is rigid. As used herein, "rigid" means a level of stiffness commonly associated with materials used to manufacture wet wipes tubs and parts thereof. Numerically, these materials in particular embodiments have a flexural modulus (as measured in accordance with ASTM D790 "Standard Test Method for Flexural Properties of Unreinforced and Reinforced Plastics and Electrical Insulating Materials") of about 100 Newtons per square millimeter or greater, more specifically from about 1100 to about 1550 Newtons per square millimeter.

The first end wall 32 can be moved to provide access to the interior space 36 via a refill orifice 38. For example, in particular embodiments, the first end wall is hingedly connected to one of the top wall 24, bottom wall 26, first side wall 28, or second side wall 30. In other embodiments, the first end wall 32 is completely removable from the remainder of the housing structure.

In the illustrated embodiments, the refill orifice 38 is a housing opening present at or near the ends of the top wall 24, bottom wall 26, first side wall 28, and second side wall 30.

Figure 12A:
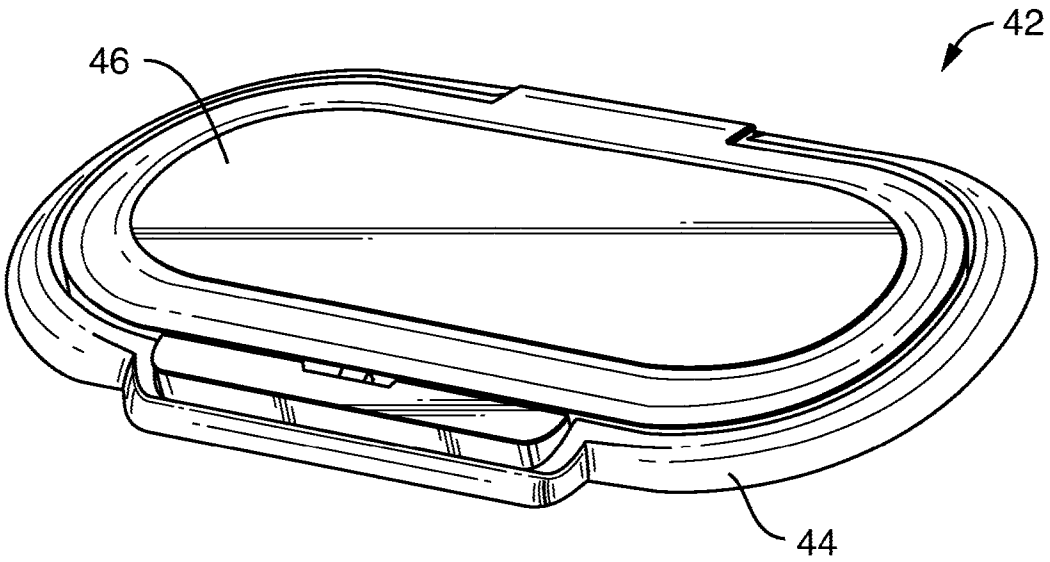
FIG. 12A is a perspective top view of a lid assembly suitable for use in conjunction with particular embodiments of the present invention.
Figure 12B:
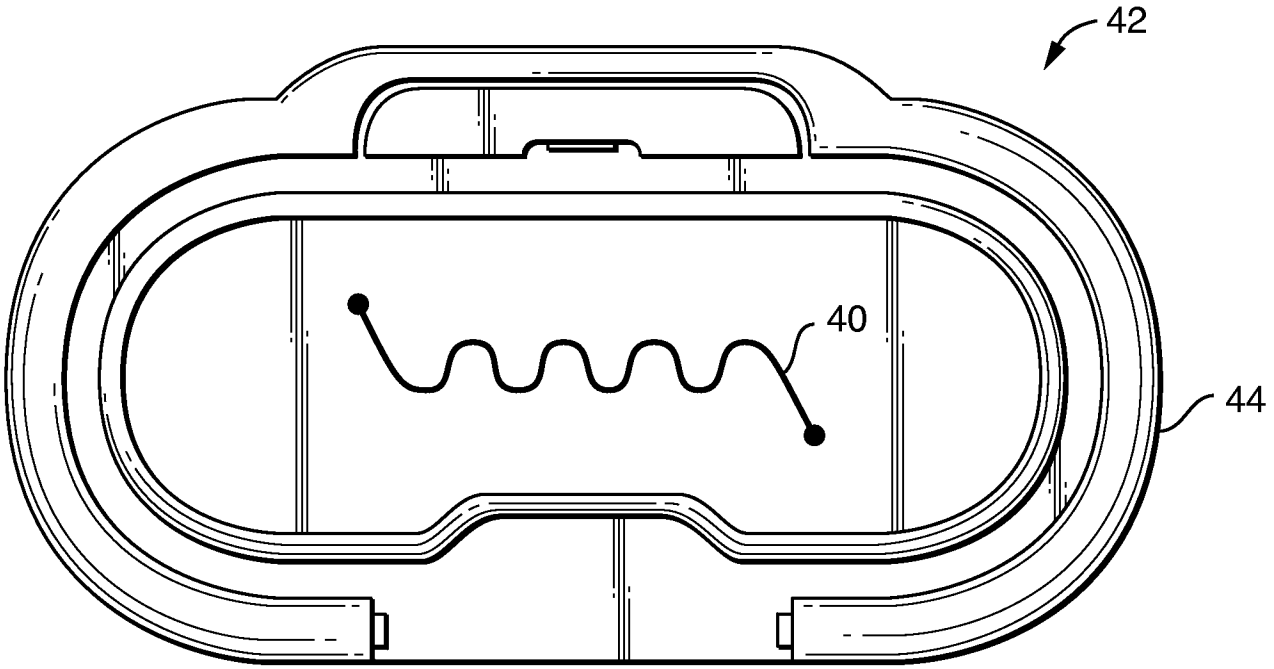
FIG. 12B is a bottom view of the lid assembly of FIG. 12A.
Figure 12C:
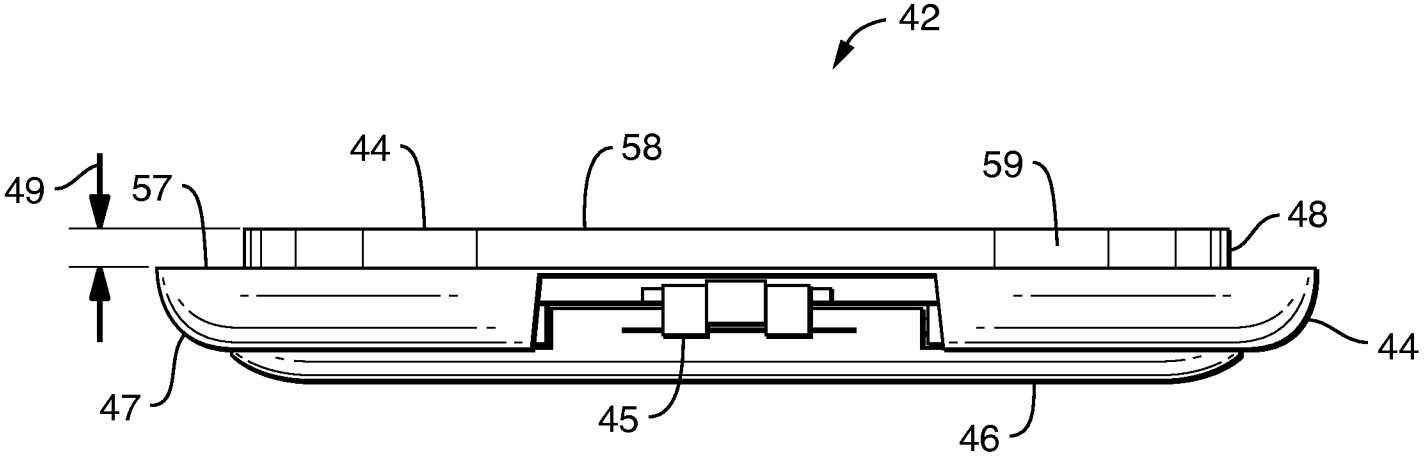
FIG. 12C is a back view of the lid assembly of FIG. 12A.
Figure 12D:
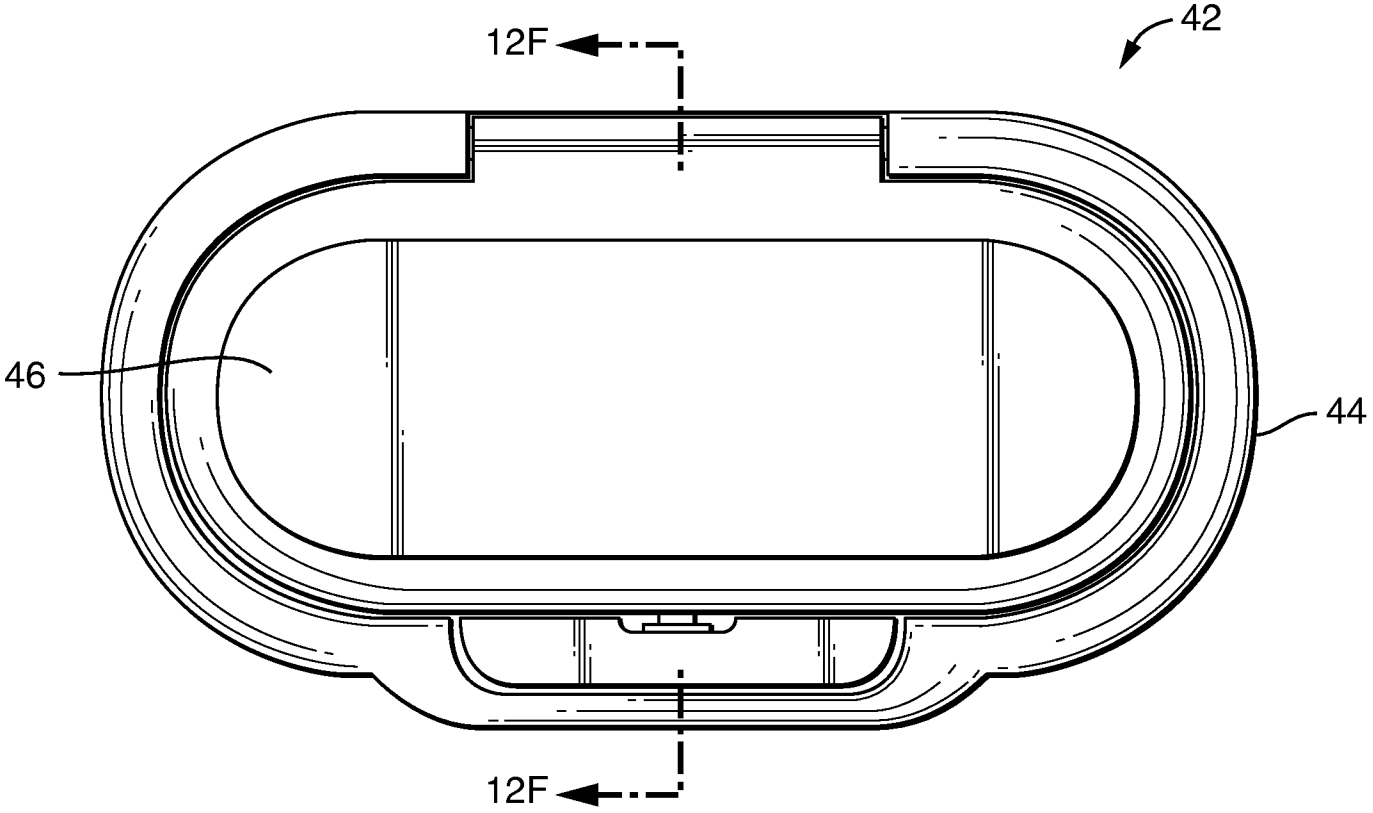
FIG. 12D is a top view of the lid assembly of FIG. 12A.
Figure 12E:
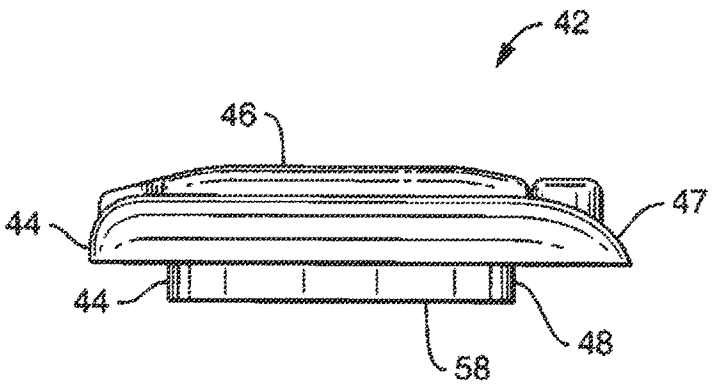
FIG. 12E is an end view of the lid assembly of FIG. 12A.
Figure 12F:
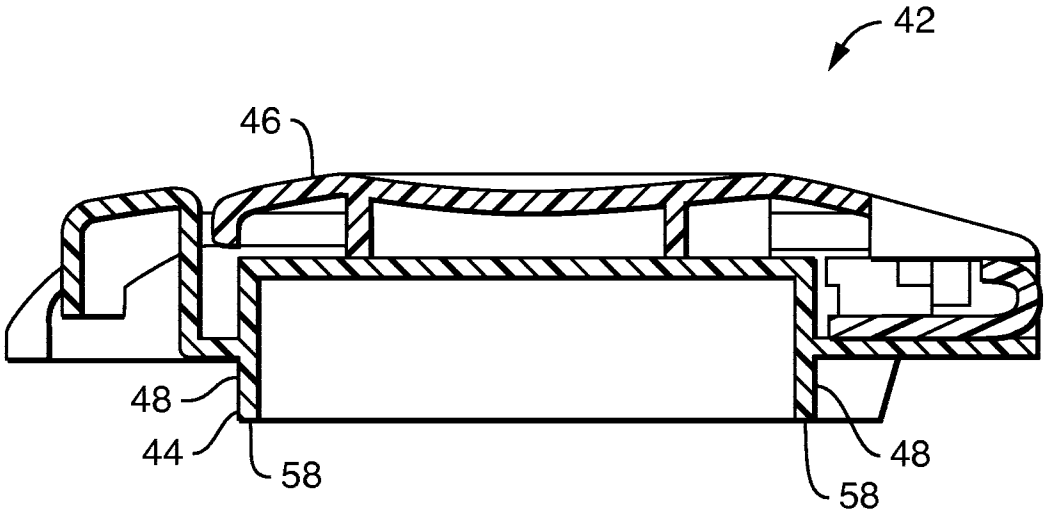
FIG. 12F is a cross-sectional view of the lid assembly of FIG. 12D taken at line 12F.

The top wall 24 includes a dispensing orifice 40 through which individual wipes 52 can be extracted (i.e., dispensed) from the interior space 36. In particular embodiments, the dispensing orifice 40 is covered by a lid assembly 42. The lid assembly 42 can include a ring 44 and a flip top 46, as shown in FIGS. 12A and 12B. The ring 44 can be permanently affixed to the top wall 24, and the flip top 46 can be hingedly connected to the ring at one or more hinges 45.

The top wall 24 has a thickness and defines an inner surface 25. The bottom wall 26 has a thickness and defines an inner surface 27. The top wall 24 is spaced apart from the bottom wall 26 in a height dimension 29. The height dimension is perpendicular to both the plane substantially defined by the top wall and the plane substantially defined by the bottom wall. The interior space 36 has an interior space height 37 that extends in the height dimension 29 from the inner surface 25 of the top wall 24 to the inner surface 27 of the bottom wall 26. "Interior space height" as used herein means the greatest distance that exists between the top wall inner surface 25 and the bottom wall inner surface 27 in the height dimension 29.

In particular embodiments, the moist wipes 52 are stacked upon each other in the height dimension 29 and are disposed within the interior space 36, and each moist wipe 52 is adapted to be extracted by a user from the interior space 36 through the dispensing orifice 40—preferably one at a time. The wipes are desirably configured within the stack 50 to provide "pop-up" dispensing. In such configurations, when a wipe is removed from the dispenser, the wipe pulls along the leading end of the succeeding wipe in the package, by virtue of the succeeding wipe being in operative contact with the leading wipe such as via interfolding, via adhesive bonding, or via an integral connection along a line of weakness. Preferably, as the leading wipe is pulled out of and away from the package, the trailing end of the leading wipe breaks free from the leading end of the succeeding wipe, and the leading end of the succeeding wipe is left protruding from the package. In this way, the leading end of the succeeding wipe is immediately and automatically positioned for grasping and subsequent withdrawal from the package, and what was previously the succeeding wipe now becomes a leading wipe. Alternatively, the container 20 may include a stack 50 of wipes 52 in a non-interfolded configuration, for "reach-in" dispensing. For such a non-interfolded wipe, each wipe may be folded onto itself with no portion of another wipe being positioned between or underneath any portion of the folds of the adjacent wipe(s).

In particular embodiments, each of the moist wipes 52 in the stack 50 are interfolded with one another, such as via c-folds, z-folds, or other zig zag folds. In other embodiments, the moist wipes 52 in the stack 50 are interconnected via frangible lines of weakness. For example, the wipes can be arranged in the housing as a continuous web of interconnected wipes which are folded in an accordion-like stacked configuration. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. Each portion of the web of material between successive lines of frangibility constitutes an individual wipe. The lines of frangibility can be provided by means known to those skilled in the art such as perforations, indentations, score lines, or cuts in the web of material.

The container of the present invention can include any suitable number of individual wipes depending upon the desired packaging and end use. For example, the container can be configured to include a stack of wipes of at least about 5 wipes and desirably from about 8 to about 320 individual wipes, and more desirably from about 16 to about 64 wipes. Each wipe is in particular embodiments generally rectangular in shape.

Materials suitable for the wipes employed in conjunction with the present invention are well known to those skilled in the art. For example, the wipes 52 can be made from non-woven materials such meltblown, coform, air-laid, or bonded-carded web materials, hydroentangled materials, high wet-strength tissue, or the like, and can comprise synthetic or natural fibers or combinations thereof. The wipes of the different aspects of the present invention can contain a liquid which can be any solution which can be absorbed into or entrained within the wipes, thus making them "wet wipes." The liquid contained within the wet wipes can include components which provide the desired wiping properties. For example, the components can include water, emollients, surfactants, preservatives, chelating agents, pH buffers, fragrances, or combinations thereof. The liquid can also contain lotions, ointments, and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 200 to about 400 weight percent liquid based on the dry weight of the wipe.

The housing 22 and/or lid assembly 42 can be opaque or, alternatively, can be transparent or translucent to allow a visual inspection of the quantity of wipes remaining in the container. The housing and/or lid assembly can be made of various polymers, copolymers, and mixtures, including, e.g., polyethylene, polypropylene, polyester, and polystyrene.

As noted above, the first end wall 32 can be removed to provide access to the interior space 36. In particular embodiments, the first end wall 32 constitutes a removable cap 60. The removable cap 60 has in particular embodiments no permanent connection to the top wall 24, bottom wall 26, first side wall 28, or second side wall 30. The removable cap 60 and housing 22 preferably are configured to snap together, such as via a tongue-and-groove or rib-and-recess relationship.

In particular embodiments, the second end wall 34 can also be removed to provide access to the interior space 36. In particular embodiments, the second end wall 34 includes a removable cap 62. The removable cap 62 has in particular embodiments no permanent connection to the top wall 24, bottom wall 26, first side wall 28, or second side wall 30. The removable cap 62 and housing 22 preferably are configured to snap together, such as via a tongue-and-groove or rib-and-recess relationship.

Figure 6A:
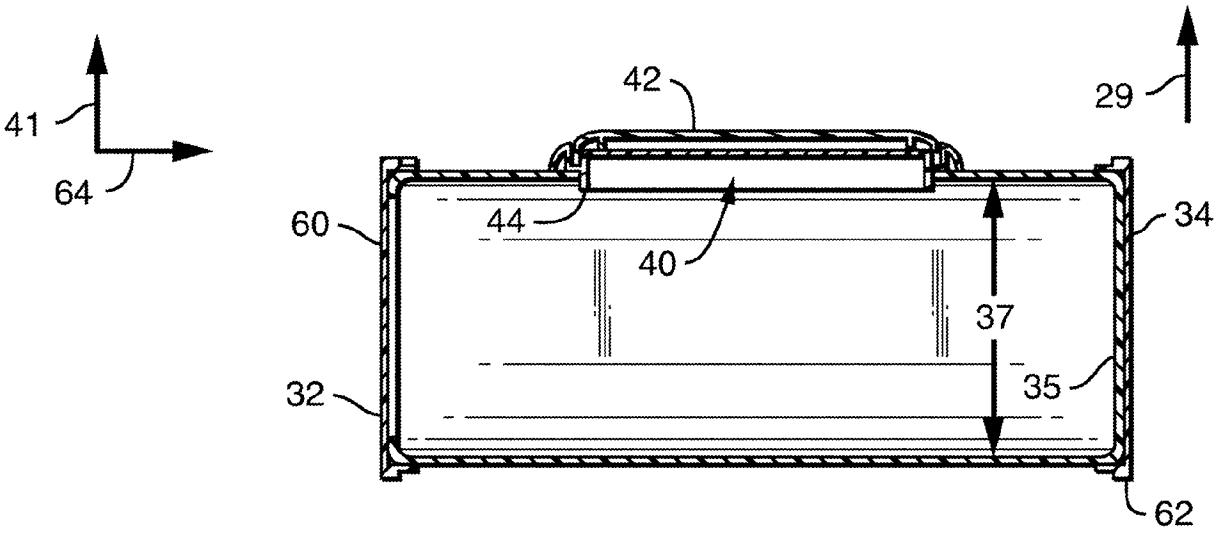
FIG. 6A representatively depicts a cross-sectional view of the embodiment of FIG. 5 taken at line 6-6, but with both end wall removable caps attached.
Figure 7A:
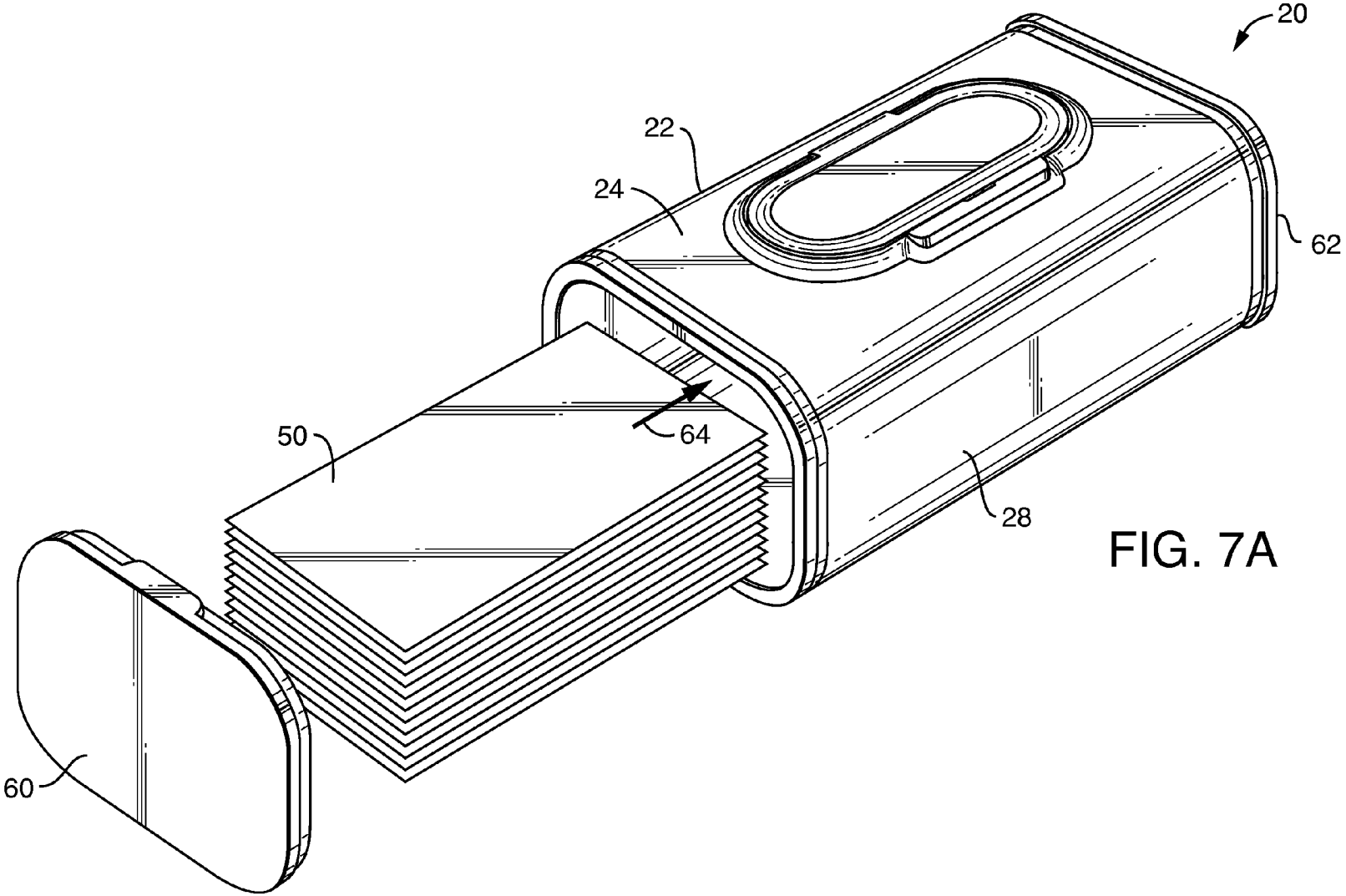
FIG. 7A representatively illustrates the embodiment of FIG. 1A, but with one end wall removable end cap and a stack of moist wipes shown in an exploded view.
Figure 7B:
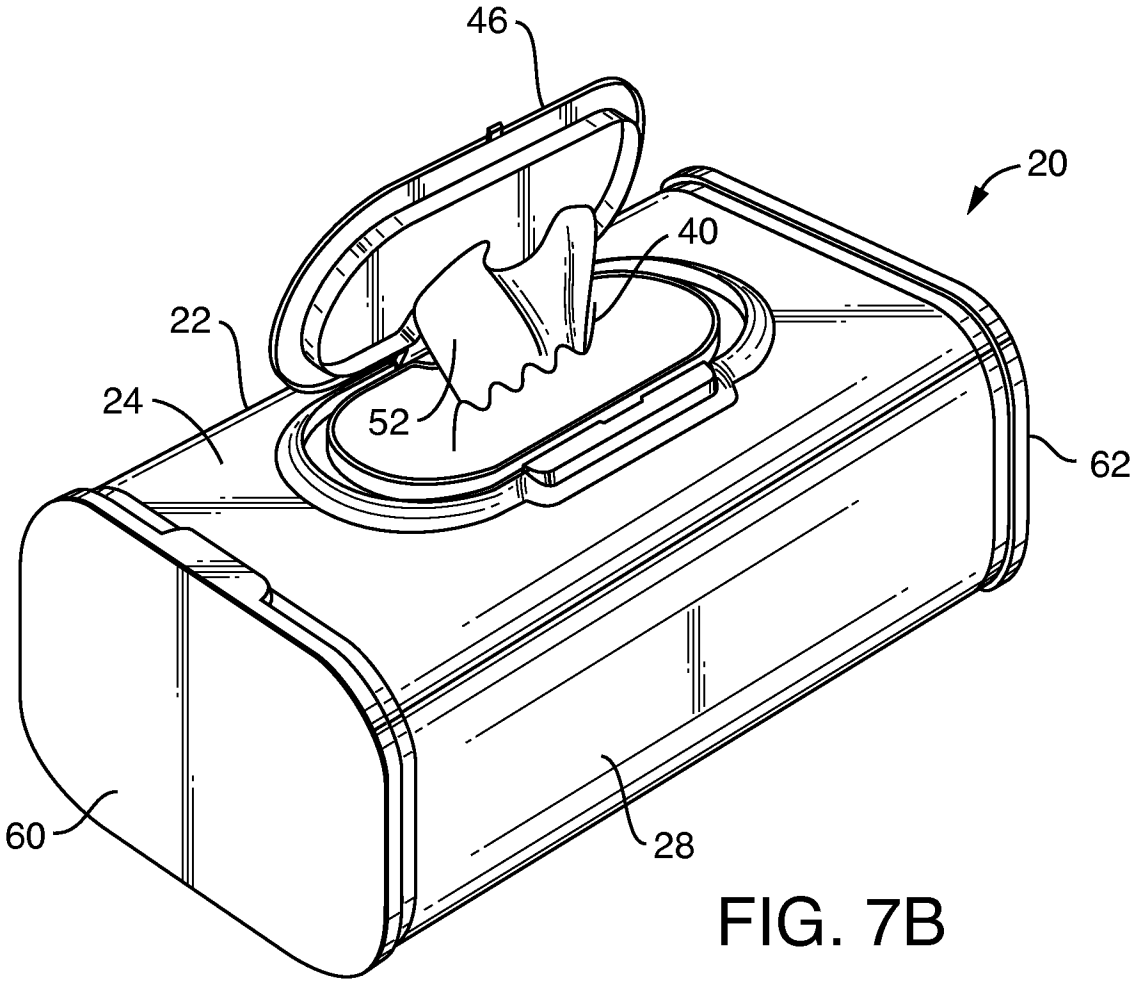
FIG. 7B is the same as FIG. 1B, but with a wipe depicted in a partially dispensed position.

By providing access to the interior space via a removable first end wall 32, a removable second end 34, or both, the dispenser housing 22 can be refilled with a new stack 50 of wipes after the previous stack of wipes has been consumed. As shown in FIG. 7A, the new stack 50 of wipes is inserted into the housing in a refill direction 64. The refill direction 64 is generally perpendicular to a dispensing direction 41, as representatively illustrated in FIGS. 6, 6A, and 8.

In particular embodiments, the second end wall 34 includes a permanent layer 35 integrally formed with the top wall 24, bottom wall 26, first side wall 28, and second side wall 30. In such embodiments, the first end wall 32 can include a first removable cap 60 (preferably having no permanent connection to the top wall 24, bottom wall 26, first side wall 28, or second side wall 30), and the second end wall 34—in addition to having a permanent, integral layer 35 as just described—also includes a second removable cap 62 (preferably having no permanent connection to the top wall 24, bottom wall 26, first side wall 28, or second side wall 30). Preferably, the second removable cap 62 is substantially identical in structure to the first removable cap 60. In this way, the first end wall 32 is in particular embodiments completely removable, thus providing access to the interior space 36, but the second end wall 34 includes a permanent, integral layer to provide improved structural integrity and/or improved moisture retention function to the container 20. At the same time, by in particular embodiments including similar or identical caps 60, 62 on each end of the container, the container is provided with the appearance of structural symmetry when fully assembled, which can provide desirable aesthetics as well improved functionality in certain circumstances. "Substantially identical in structure" as used in this context means that the first and second removable caps are sufficiently structurally similar such that they can be switched and attached to opposite ends of the housing, but can possess minor differences with respect to each other, such as the presence of a finger tab or a molded brand name on one cap but not the other.

As noted earlier, the interior space 36 has an interior space height 37 that extends from the inner surface 25 of the top wall 24 to the inner surface 27 of the bottom wall 26. The stack 50 of wipes 52 defines a stack height 51. It has been discovered that if the stack height 51 is the same as the interior space height 37, two problems can in certain circumstances result. First, if the top 53 of the stack 50 is too firmly pressed against the inner surface 25 of the top wall 24, dispensing of the top wipe or wipes in the stack 50 can be impeded. Second, the lid assembly 42 may in particular aspects of the invention protrude slightly through the dispensing orifice 40 into the interior space 36 (described in more detail below). In such embodiments, if the stack height 51 is the same as the interior space height 37, the stack 50 of wipes 52 will collide with the inwardly protruding portion of the lid assembly 42 when the stack 50 is inserted into the interior space 36 through the refill orifice 38, which can lead to crumpling and clogging of wipes within the container. For these two reasons, it is desirable with certain embodiments of the container 20 to control the stack height 51 of stacks 50 that can be used to refill the container 20.

To meet this need, an arrangement to limit stack height 51 has been invented. The refill orifice 38 has a refill orifice height 39 extending in the height dimension 29. In particular embodiments, the refill orifice height 39 is less than 95%, and more particularly less than 90%, of the interior space height 37. One technique suitable for providing a refill orifice height 39 that is less than the interior space height 37 is by use of an end flange. For example, in one embodiment, representatively illustrated in FIGS. 5 and 8, the refill orifice 38 is partially bordered by at least one end flange 70. The end flange 70 extends from the top wall 24 toward the bottom wall 26 and terminates at an end flange edge 71. The end flange 70 is in particular embodiments integrally formed with the top wall 24.

Figure 5:
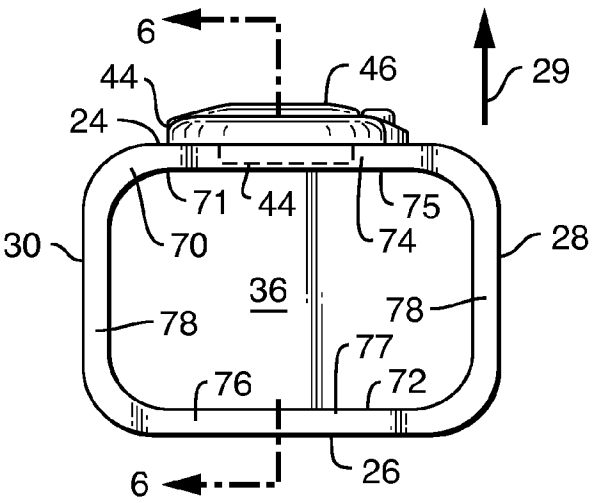
FIG. 5 representatively illustrates an end view of the embodiment of FIG. 10, with the end wall removable cap absent.
Figure 8:
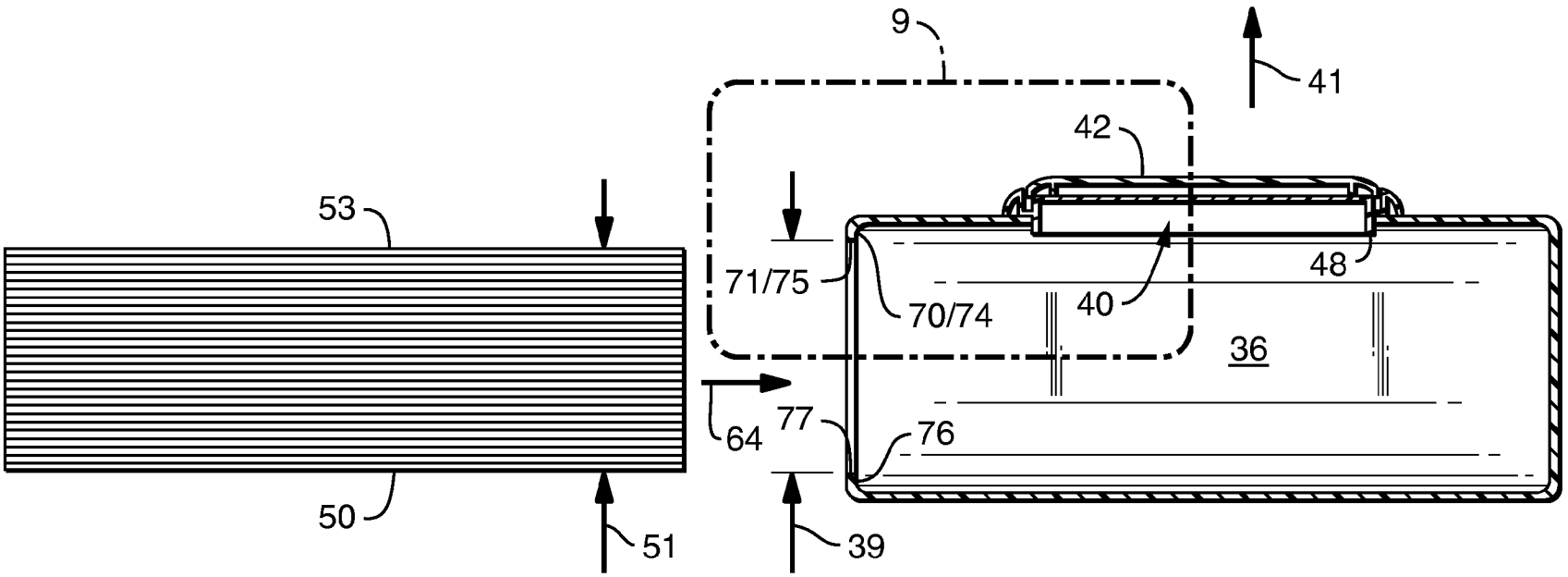
FIG. 8 representatively illustrates the same embodiment and view depicted in FIG. 6, along with a front view of a stack of moist wipes suitable for use in conjunction with particular embodiments of the invention.

Still referring to FIGS. 5 and 8, in particular embodiments, the refill orifice 38 is surrounded by a continuous end flange 72. An upper portion 74 of the continuous end flange 72 extends from the top wall 24 toward the bottom wall 26 and terminates at an upper portion edge 75. Preferably, the upper portion 74 is integrally formed with the top wall 24. Further, a lower portion 76 of the continuous end flange 72 extends from the bottom wall 26 toward the top wall 24 and terminates at a lower portion edge 77. Preferably, the lower portion 76 is integrally formed with the bottom wall 26. The continuous flange also includes side portions 78, 78. In additional to limiting the height 51 of the stack 50 that can be inserted into the housing, a continuous end flange 72 can in particular embodiments provide additional structural integrity to the housing 22.

As noted above, the lid assembly 42 in particular embodiments includes a ring 44 and a flip top 46, and the ring 44 is preferably permanently affixed to the top wall 24. Referring to FIGS. 8-10 and 12A-12F, in particular embodiments, the ring 44 includes an upper portion 47 and a buffering flange 48. The upper portion 47 overlaps and generally extends along the dispensing orifice perimeter 43. The upper portion 47 is the portion of the ring 44 that extends outward from the top wall 24 ("outward" as used herein meaning away from the interior space 36). The buffering flange 48 protrudes from the upper portion 47 into the interior space 36. The top wall 24 has a thickness 23, and the buffering flange has a height 49. The thickness 23 of the top wall 24 as referenced herein means the thickness measured via any suitable means (such as a caliper) measured approximately one centimeter away from the dispensing orifice perimeter 43. The height 49 of the buffering flange 48 as referenced herein means the distance from the underside 57 of the upper portion 47 to the distal end 58 of the buffering flange 48. In particular embodiments, the buffering flange height 49 is greater than the top wall thickness 23. For example, in particular embodiments, the height 49 of the buffering flange 48 is at least 20% greater, more particularly at least 50% greater, and still more particularly at least 100% greater than the thickness 23 of the top wall 24.

In particular embodiments, the buffering flange 48 defines a buffering flange outer perimeter 59. In particular embodiments, the length of the buffering flange outer perimeter 59 is less than the length of the dispensing orifice perimeter 43. Preferably, the length of the buffering flange outer perimeter 59 is only slightly less (e.g., between 0% and 2% less) than the length of the dispensing orifice perimeter 43, such that the buffering flange 48 fits snugly into the dispensing orifice 40.

As noted above, in particular embodiments, the first end wall can be removed to provide access to the interior space via a refill orifice 38, and the refill orifice 38 can be partially bordered by at least one end flange. In particular embodiments, the end flange 70 has an end flange height 73. The end flange height as referenced herein is the distance measured from the top wall inner surface 25 to the end flange edge 71, as representatively illustrated in FIGS. 9 and 10. In particular embodiments, the sum of the end flange height 73 and the top wall thickness 23 is greater than the buffering flange height 49. Similarly, as described above, in particular embodiments the refill orifice 38 is surrounded by a continuous end flange 72. The upper portion 74 of the continuous end flange 72 has a continuous end flange upper portion height, measured from the top wall inner surface 25 to the upper portion edge 75. In particular embodiments, the sum of the continuous end flange upper portion height and the top wall thickness 23 is greater than the buffering flange height 49. In this way, the stack height 51 of the stacks 50 that are used to refill the container 20 can in particular embodiments be controlled so that the stack 50 does not collide with or press against the buffering flange 48 as the refill is inserted or after the refill has been completely inserted into the interior space 36.

Figure 10:
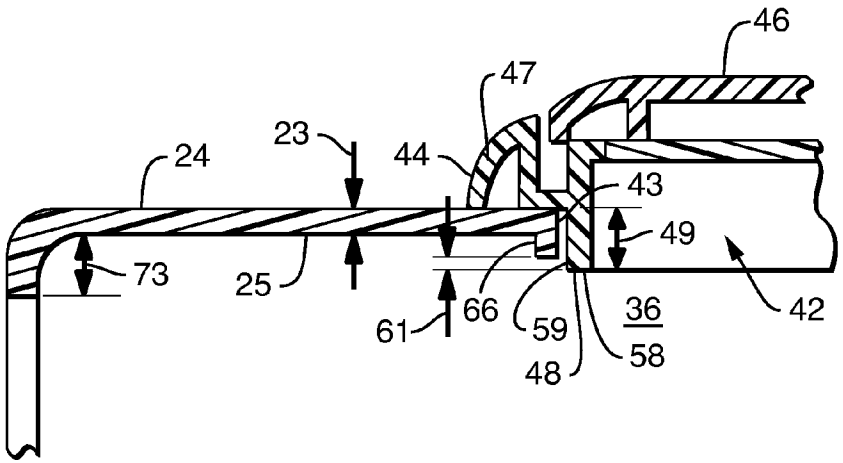
FIG. 10 is a detail view of an alternative embodiment of the portion of FIG. 8 indicated by reference numeral 9.
Figure 9:
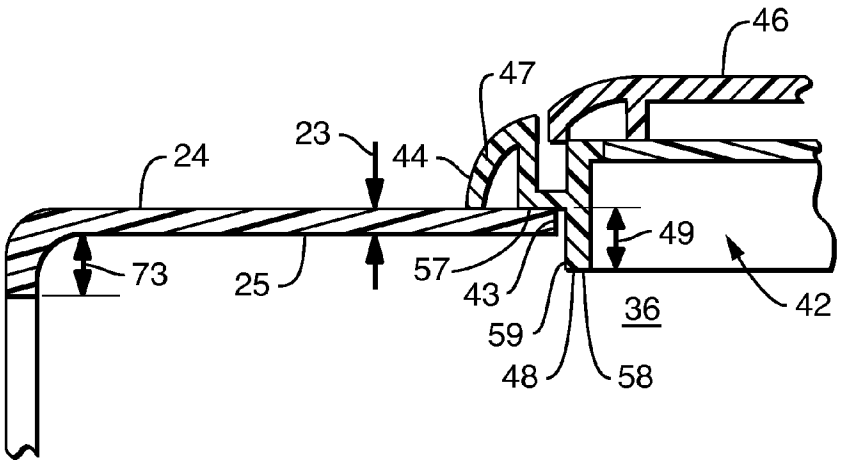
FIG. 9 is a detail view of the portion of FIG. 8 indicated by reference numeral 9.
Figure 11:
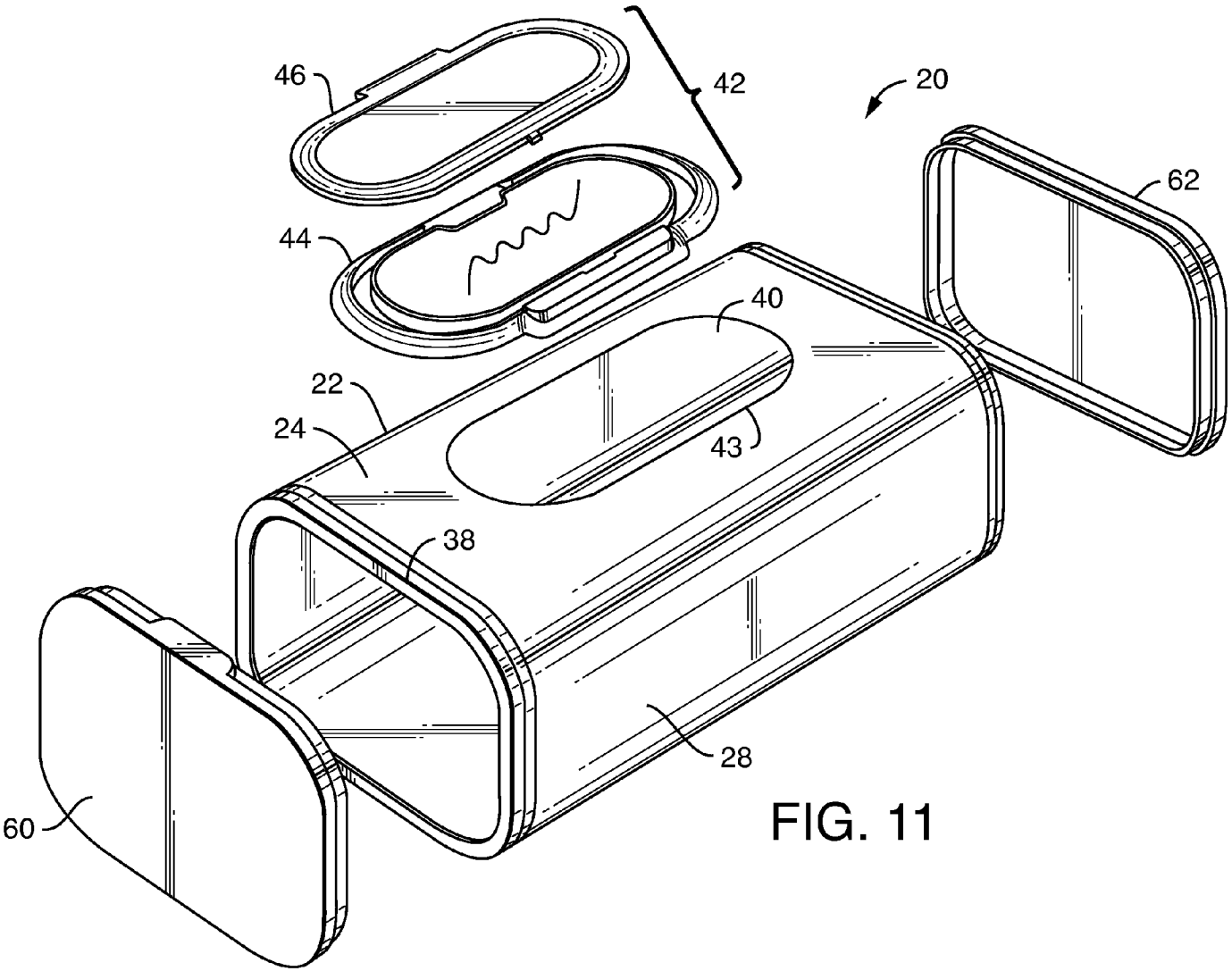
FIG. 11 representatively illustrates the embodiment of FIG. 1A, but with both end wall removable end caps and the lid assembly shown in a exploded view.

In certain embodiments, referring to FIGS. 8-10, the buffering flange 48 protrudes from the flip top upper portion 47 into the interior space 36 past the inner surface 25 of the top wall 24. In particular embodiments, such as that representatively illustrated in FIG. 10, the top wall 24 includes a top wall flange 66 integrally formed with the top wall 24. In particular embodiments, the top wall flange 66 surrounds the dispensing orifice 40 and extends into the interior space 36. For example, in one preferable process for commercially manufacturing the container 20, the dispenser housing 22 is blow-molded, and the dispensing orifice 40 is created by cutting or stamping out a section of material. This cutting or stamping step can create a flange 66 in the top wall 24, and such flange 66 can in particular embodiments be rough or jagged. In particular embodiments, the buffering flange 48 extends into the interior space 36 further than the top wall flange 66 extends into the interior space 36. For example, in particular embodiments, the buffering flange 48 extends past the top wall flange 66 by a distance 61 of at least one millimeter, and more particularly by at least two millimeters. In this way, as a wipe 52 is extracted from the interior space 36 through the dispensing orifice 40, the buffering flange 48 will prevent the wipe from catching or snagging on the top wall flange 66, thus allowing smooth, unhindered passage of the wipe out of the container.

It will be appreciated that details of the foregoing embodiments, given for purposes of illustration, are not to be construed as limiting the scope of this invention. Although only a few exemplary embodiments of this invention have been described in detail, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

I claim:

1. A container for moist wipes, the container comprising:

a dispenser housing defining a top wall spaced apart from and generally parallel to a bottom wall, a first side wall spaced apart from and generally parallel to a second side wall, and a first end wall spaced apart from and generally parallel to a second end wall, wherein all of the walls collectively define an interior space, wherein the top wall includes a dispensing orifice through which wipes can be extracted from the interior space, wherein the top wall is spaced apart from the bottom wall in a height dimension, the interior space having an interior space height that extends from an inner surface of the top wall to an inner surface of the bottom wall, the dispensing orifice defining a dispensing orifice perimeter;

wherein the dispensing orifice is covered by a lid assembly, the lid assembly comprising a ring and a flip top, the ring being permanently affixed to the top wall, and the flip top being hingedly connected to the ring, the ring having an upper portion and a buffering flange, the upper portion overlapping and generally extending along the dispensing orifice perimeter, wherein the buffering flange is formed integrally with and protrudes from the upper portion into the interior space, wherein a height of the buffering flange is greater than a thickness of the top wall, wherein the first end wall can be removed to provide access to the interior space via a refill orifice.

2. The container of claim 1 wherein the height of the buffering flange is at least 20% greater than the thickness of the top wall.

3. The container of claim 2 wherein the height of the buffering flange is at least 50% greater than the thickness of the top wall.

4. The container of claim 1 wherein the buffering flange defines a buffering flange outer perimeter, wherein a length of the buffering flange outer perimeter is less than a length of the dispensing orifice perimeter, wherein the buffering flange outer perimeter defines a closed loop.

5. The container of claim 1 wherein the refill orifice is partially bordered by at least one end flange, the end flange extending from the top wall toward the bottom wall and terminating at an end flange edge, the end flange being integrally formed with the top wall, wherein the end flange has an end flange height, and further wherein a sum of the end flange height and the top wall thickness is greater than a buffering flange height.

6. The container of claim 1 wherein the refill orifice is surrounded by a continuous end flange, wherein an upper portion of the continuous end flange extends from the top wall toward the bottom wall and terminates at an upper portion edge, the upper portion being integrally formed with the top wall, and wherein a lower portion of the continuous end flange extends from the bottom wall toward the top wall and terminates at a lower portion edge, the lower portion being integrally formed with the bottom wall, wherein the continuous end flange upper portion has a continuous end flange upper portion height, and further wherein a sum of the continuous end flange upper portion height and the top wall thickness is greater than a buffering flange height.

7. The container of claim 1 further comprising a stack of moist wipes stacked upon each other in the height dimension and disposed within the interior space, each moist wipe adapted to be extracted from the interior space through the dispensing orifice.

8. A container for moist wipes, the container comprising:

a dispenser housing defining a top wall spaced apart from and generally parallel to a bottom wall, a first side wall spaced apart from and generally parallel to a second side wall, and a first end wall spaced apart from and generally parallel to a second end wall, wherein all of the walls collectively define an interior space, wherein the top wall includes a dispensing orifice through which wipes can be extracted from the interior space, wherein the top wall is spaced apart from the bottom wall in a height dimension, the interior space having an interior space height that extends from an inner surface of the top wall to an inner surface of the bottom wall, the dispensing orifice defining a dispensing orifice perimeter;

wherein the dispensing orifice is covered by a lid assembly, the lid assembly comprising a ring and a flip top, the ring being permanently affixed to the top wall, and the flip top being hingedly connected to the ring, the ring having an upper portion and a buffering flange, the upper portion overlapping and generally extending along the dispensing orifice perimeter, wherein the buffering flange is formed integrally with and protrudes from the upper portion into the interior space past the inner surface of the top wall, wherein the first end wall can be removed to provide access to the interior space via a refill orifice.

9. The container of claim 8 wherein the top wall includes a top wall flange integrally formed with the top wall, the top wall flange surrounding the dispensing orifice and extending into the interior space, wherein the buffering flange extends into the interior space further than the top wall flange extends into the interior space.

10. The container of claim 9 wherein the buffering flange extends past the top wall flange by at least one millimeter.

11. The container of claim 8 wherein the buffering flange defines a buffering flange outer perimeter, wherein a length of the buffering flange outer perimeter is less than a length of the dispensing orifice perimeter, such that the buffering flange fits snugly into the dispensing orifice, and wherein the buffering flange outer perimeter defines a closed loop.

12. The container of claim 8, wherein the refill orifice is partially bordered by at least one end flange, the end flange extending from the top wall toward the bottom wall and terminating at an end flange edge, the end flange being integrally formed with the top wall, wherein the end flange has an end flange height, and further wherein a sum of the end flange height and the top wall thickness is greater than a buffering flange height.

13. The container of claim 8, wherein the refill orifice is surrounded by a continuous end flange, wherein an upper portion of the continuous end flange extends from the top wall toward the bottom wall and terminates at an upper portion edge, the upper portion being integrally formed with the top wall, and wherein a lower portion of the continuous end flange extends from the bottom wall toward the top wall and terminates at a lower portion edge, the lower portion being integrally formed with the bottom wall, wherein the continuous end flange upper portion has a continuous end flange upper portion height, and further wherein a sum of the continuous end flange upper portion height and the top wall thickness is greater than a buffering flange height.

14. The container of claim 8, wherein the container further comprises a stack of moist wipes stacked upon each other in the height dimension and disposed within the interior space, each moist wipe adapted to be extracted from the interior space through the dispensing orifice.

* * * * *